United States Patent [19]

Carver

[11] 4,448,308

[45] May 15, 1984

[54] COLLAPSIBLE DISPLAY CARRIER

[75] Inventor: Robert G. Carver, Ashland, Ohio

[73] Assignee: Don Coburn, Inc., Ashland, Ohio

[21] Appl. No.: 390,627

[22] Filed: Jun. 21, 1982

[51] Int. Cl.[3] ..... B65D 85/44

[52] U.S. Cl. ..... 206/426; 206/427; 206/434; 206/429; 229/40

[58] Field of Search ..... 206/45.14, 45.19, 426, 206/434, 427, 170, 175; 229/40, 41 R, 41 B, 27, 15, 39 B; 206/429

[56] References Cited

U.S. PATENT DOCUMENTS

| | | | |
|---|---|---|---|
| 2,795,365 | 6/1957 | Currie | 206/427 |
| 2,943,427 | 7/1960 | Fisher | 206/434 |
| 3,598,302 | 8/1971 | Nowak | 229/40 |
| 3,780,906 | 12/1973 | Katzenmeyer | 206/170 |
| 3,931,888 | 1/1976 | Fogel | 206/434 |
| 4,029,207 | 6/1977 | Gorden | 229/40 |
| 4,037,721 | 7/1977 | Schillinger | 206/426 |
| 4,130,202 | 12/1978 | Champlin et al. | 229/40 |
| 4,155,450 | 5/1979 | Schillinger | 206/426 |
| 4,212,391 | 7/1980 | Schillinger | 206/426 |

*Primary Examiner*—Joseph Man-Fu Moy
*Assistant Examiner*—David Fidei
*Attorney, Agent, or Firm*—Squire, Sanders & Dempsey

[57] ABSTRACT

A collapsible display carrier for articles having top, bottom, and side walls hingedly joined to form a sleeve, the side walls having lateral fold lines, said carrier including collapsible retaining means attached to the side walls and the bottom wall for engaging articles inserted into the carrier, said carrier being collapsible to a substantially flat configuration about a lateral plane lying intermediate of the top and bottom walls.

14 Claims, 5 Drawing Figures

COLLAPSIBLE DISPLAY CARRIER

BACKGROUND OF THE INVENTION

The present invention relates to carriers for articles, such as tumblers, goblets and the like, which are used to pack the articles for shipping and to display them for sale. Such carriers do not fully enclose the articles so that the prospective purchaser may be attracted by their appearance and inspect them before purchase.

Typically, a manufacturer specializing in paper board and/or plastic sheet goods prepares a display carrier from paper or plastic, partially or completely assembles it and ships it in a flattened state to the manufacturer of articles. The articles manufacturer erects and assembles the carriers as necessary, inserts the articles into them and ships the goods to retailers. Carriers generally require some degree of assembly by the article manufacturer because they cannot be flattened or collapsed after full assembly. To reduce expense it is desirable to manufacture display carriers which may be fully assembled and then collapsed.

One such collapsible display carrier is disclosed in U.S. Pat. No. 3,884,353 to Forte. That X-shaped carton, although it may be assembled and then flattened, requires substantial handling for erection, since the sides must be "popped" into place. Other collapsible display carriers are disclosed in U.S. Pat. Nos. 4,155,450 and 4,212,391 to Schillinger. In these related disclosures, the carrier includes end-to-end divider walls having latch means for holding the divider walls in place. Once the carrier is erected, the latch means must be unlocked by hand to collapse the carrier. Yet another carrier is disclosed in U.S. Pat. No. 4,130,202 to Champlin, et al. While that carrier may be folded flat, it requires the insertion of a probe or finger through an access hole to lock or unlock it, to or from its fully assembled condition, respectively. The carriers disclosed by Champlin and Schillinger and are collapsed along fold lines joining the top and bottom walls to the side walls. That is, the collapsing is unsymmetrical since the glassware retainers inside the carriers must be pushed to one side or the other of the carrier for collapsing.

SUMMARY OF THE INVENTION

In the present invention, a display carrier is provided that may be collapsed or erected at will, when empty, simply by placing compressive forces on its top and bottom walls or on its side walls, respectively. When articles are in place in the carrier, the carrier is held in its erect condition by them. The side walls of a carrier according to the invention have lateral fold lines. The carrier may be collapsed about a transverse plane lying intermediate of the top and bottom walls, i.e., symmetrically, for efficient packing of the carriers in shipping cartons.

The inventive carrier includes a collapsible retaining means for holding articles within the carrier. A divider wall is hingedly attached to the bottom wall of the carrier and extends between the opposing side walls to which it is also hinged. A support wall hingedly attached to an edge of the bottom wall is hingedly attached to the divider wall. The support wall includes at least one partially elliptical opening for receiving the article to be inserted into and displayed from within the carton. The support wall includes a transverse fold line so that the divider wall, bottom wall, and support wall form, in cross section, a trapezoid which may be collapsed to a substantially flat configuration. The trapezoidal configuration allows the article retaining means to be collapsed with the carrier. The divider wall is attached at each of its ends to the adjacent side wall by a double acting, i.e., two axis, hinge. When the carrier is erected, the double acting hinges cause the divider wall to be erected into a position generally perpendicular to the bottom wall. When the carrier is collapsed, the double acting hinges ensure that the divider wall, and thereby the support wall, is pulled down and folded to a position generally parallel to the bottom wall.

The invention is more clearly explained with reference to a preferred embodiment shown in the drawing figures.

DETAILED DESCRIPTION OF THE PREFERRED EMBODIMENT

Figure 1:
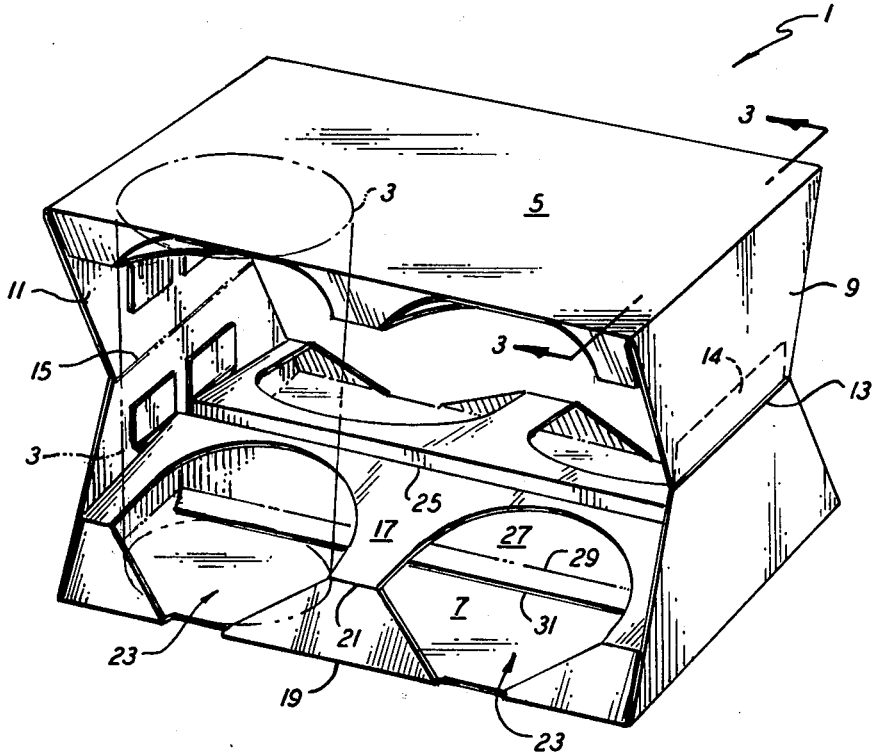
FIG. 1 is a perspective view of an embodiment of a carrier according to the invention.

In FIG. 1, a perspective view of a preferred embodiment of an assembled carrier 1 is shown with a drinking glass 3, shown in phantom, held within the carrier. The carrier has a top wall 5, a bottom wall 7, and end walls 9 and 11. As used in this description, top and bottom refer to opposing walls of carrier 1 which bound the ends of articles inserted into the carrier and do not refer to a particular orientation of the carrier. Top wall 5 and bottom wall 7 are hingedly joined to side walls 9 and 11 by lateral fold lines, which may act as hinge axes, to form a sleeve. As used in this description, lateral refers to a direction running along or parallel to the direction of the hinged connections of side wall 9 to top and bottom walls 5 and 7. Transverse means a direction generally perpendicular to the lateral direction. These directions will become more apparent in the description of FIG. 5, a blank from which carrier 1 may be formed.

Side walls 9 and 11 include lateral fold lines 13 and 15, respectively, which serve as hinge axes for collapsing carrier 1 about a transverse plane intermediate of top and bottom walls 5 and 7. Fold lines 13 and 15 divide side walls 9 and 13, respectively, into upper and lower half side walls. The upper half side walls lie nearer top wall 5 and the lower side walls lie nearer bottom wall 7. Fold line 13 in side wall 9 actually includes a fold line in a glue flap of a blank, joined, with an adhesive, of an opposite end of a blank to form a sleeve. As indicated by the dashed line, an adhesive flap 14 is formed on the lower half side wall of side wall 9 and overlaps and is adhered on the inside of the carrier sleeve to the upper half side wall of side wall 9. In the preferred embodiment, the fold lines 13 and 14 are medially disposed on side walls 9 and 11 dividing the side walls into identical upper and lower half side walls. Side walls 9 and 11 are shown as identical with straight, oblique edges having a narrowmost midpoint at their respective medial fold lines. The purpose of the shape of the edges of the side walls is to display the articles in the carrier and the edges may be straight or arcuate, depending upon the shape of the articles in the carrier and the degree of article protection and visibility desired. A support wall 17 hingedly extends from a transverse edge of bottom wall 7, having along a transverse fold line 19 which forms an a transverse hinge axis and an edge of bottom wall 7. Support wall 17 includes a hinge having a transverse axis 21 which is preferably a fold line. Support wall 17 also includes a pair of partially elliptical openings 23 for receiving and engaging the ends of articles inserted into the carrier. Transverse hinge axis 21 intersects openings 23. Openings 23 in the support wall are designed to provide support and to constrain movement of the ends of articles in carrier 1 to prevent damage in shipping and handling. The design of the openings will vary according to the shape of the articles, but is within the skill in the art. Carrier 1 is designed to carry four articles, two on the near side of the view of FIG. 1 and two on the far side. The inventive carrier may be designed to accommodate any number of pairs of articles by lengthening or shortening the carrier in the transverse direction and increasing or reducing the number of openings in wall 17. These changes will occur to one skilled in the art and therefore need not be further described.

Support panel 17 is connected along a transverse fold line 25, which acts as a hinge axis, to a divider wall 27. Divider wall 27, in turn, has a transverse hinge axis 29, which may be a fold line, or, preferably, a combination of alternating fold and score or cut lines to reduce the resiliency of the hinge, which joins to a securing flap 31. Flap 31 is joined by an adhesive to bottom wall 7 on the inside of carrier 1 so that divider wall 27 is substantially perpendicular to bottom wall 7 when the carrier is erect. Divider wall 27, and support panel 17, extend from the lower half of side wall 13 to the lower half of side wall 15. Proximate each lower half side wall and dividing wall 27 is a hinge means for hingedly attaching divider wall 27 to the lower half side walls. Together, the hinge means, divider wall 27 and support wall 17 form a collapsible retaining means attached to bottom wall 7 and to the lower half side walls for retaining articles inserted into opening 23 of carrier 1 when the carrier is erect. Since the natural resiliency of the material encourages partial collapse of carrier 1, the presence of articles within carrier 1 holds the carrier erect. As will be appreciated by one skilled in the art, the exterior dimensions of carrier 1 are determined by the dimensions of articles inserted within it and the number of articles to be accommodated. When the articles are not present, the carrier, including the collapsible retaining means, may be collapsed to a substantially flat configuration as hereinafter explained.

Carrier 1 is symmetrical in function on each side of the lateral medial plane containing fold lines 13 and 15. Therefore, it is necessary only to describe the portion of the carrier lying between bottom wall 7 and that lateral medial plane to understand the functioning of carrier 1. Likewise, carrier 1 is functionally symmetrical with respect to a medial transverse plane, so that it is necessary to describe only the carrier half lying on the side of the medial transverse plane nearer the viewer of FIG. 1 to understand the functioning of the carrier. Because of those symmetries, most of the following description is limited to the quarter of carrier 1 lying between a medial plane containing fold lines 13 and 15 and, in front of, i.e., nearer the viewer of FIG. 1, of a medial transverse plane, since an understanding of the functioning of that quarter of carrier 1 is sufficient to understand the invention.

Figure 2:
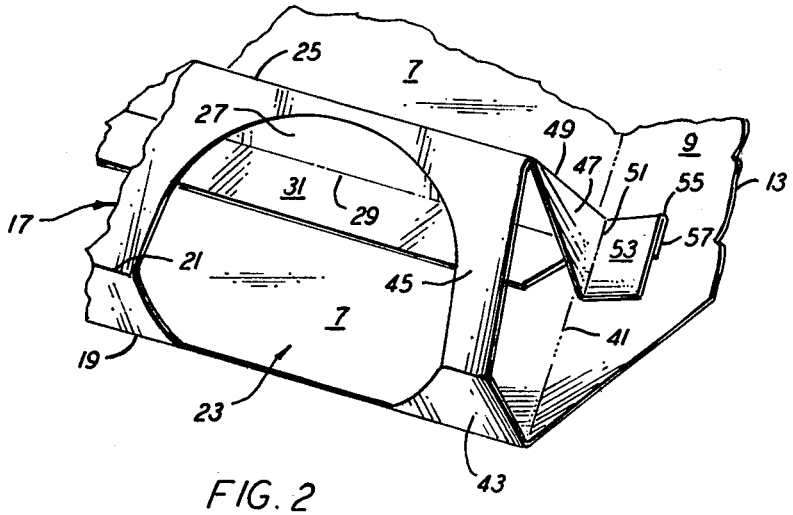
FIG. 2 is a sectional perspective view of a portion of the carrier of FIG. 1.

In FIG. 2, a detailed perspective view of a portion of carrier 1 is shown, depicting an embodiment of a hinge means according to the invention. (Like elements in all the figures are given the same reference numerals.) Only the lower half side wall of side wall 9 is shown in FIG. 2, the half being terminated by fold line 13. A lateral fold line 41 provides a hinge axis and hinged connection between the lower half side wall and bottom wall 7. Approximately one-fourth of bottom wall 7 or carrier 1 is shown. The portion of support wall 17 shown includes one opening 23 and hinge axis 21 intersecting opening 23, dividing support wall 17 into a narrow portion 43 hinged along fold line 19 to a transverse edge of bottom wall 7 and a wide portion 45 hinged to divider wall 27 along a hinge axis, namely fold line 25. Divider wall 27 joins securing flap 31 along fold line 29, flap 31 being glued to bottom wall 7. Fold lines 25 and 29 may include scored or cut portions to reduce resiliency and resistance to collapsing.

A triangular web 47 extends from divider wall 27 along a fold line 49, which is substantially transverse in the erect carrier and lies at the end of divider wall 27 adjacent the lower half side wall of side wall 9. Fold line 49 defines one edge of web 47 and serves as a hinge axis. A reverse fold line 51 defines another edge of web 47, and another hinge axis, from which a first securing tab 53 extends. A second securing tab 57 is folded along a fold line 55 onto first securing tab 53. Fold lines 49, 51 and 55 may include scored or cut portions to enhance foldability and the collapsibility of the carton. The opposing faces of tabs 53 and 57 are firmly attached to each other by an adhesive and tab 57 is adhered to the lower half side wall by an adhesive. By virtue of the attachment of tabs 53 and 57 to the lower half side wall, fold line 51 lies substantially on side wall 9. Tabs 53 and 57 are attached to each other and to side wall 9 in a location so that not only do fold lines 49 and 51 intersect each other, but that their intersection and the intersection of fold lines 29 and 41 all intersect at a point, or effectively so within the tolerance of the thickness and resiliency of the material from which carrier 1 is constructed. The term intersect, as used herein, refers to an intersection of imaginary straight lines extending through and beyond the referenced fold lines rather than an actual, physical intersection of fold lines. As will be clearer from FIG. 5, to avoid binding, portions of the web and tabs are cut away from the actual point where fold lines 29, 41, 49 and 51 would intersect if the material were not removed. Tab 57 provides preferred, additional spacing between side wall 9 and divider wall 27 to avoid binding during the collapsing and erecting of the carrier, but is not essential to the invention. Fold line 51 is referred to as a reverse fold line because it is folded in the opposite direction around its axis from the other fold lines of the carrier. The folding direction of the fold lines will be clearer by reference to FIG. 5 and its description. Since fold line 51 is reversed, when the angle between the lower half side wall of side wall 9 and bottom wall 7 is reduced, i.e., the carrier is being erected, one surface of web 47 folds toward a surface of securing tab 53 reducing the angle between them, and the angle between web 47 and divider wall 27 is also reduced. Upon collapse of the carrier, those angles increase. In other words, upon collapse of carrier 1 along lateral fold lines 13 and 15 so that the angle between the lower half side wall of side wall 9 and bottom wall 7 increases, web 47 is pulled by the lower half side wall and, in turn, pulls on divider wall 27 causing wall 27 to pivot along fold line 29 and to approach bottom wall 7. At the same time, support wall 17 pivots on fold lines 19, 21 and 25 to approach a substantially flat configuration. When the carrier is erected, web 47 pushes on divider wall 27 causing the collapsible retaining means to be pulled into an erect position.

Figure 3:
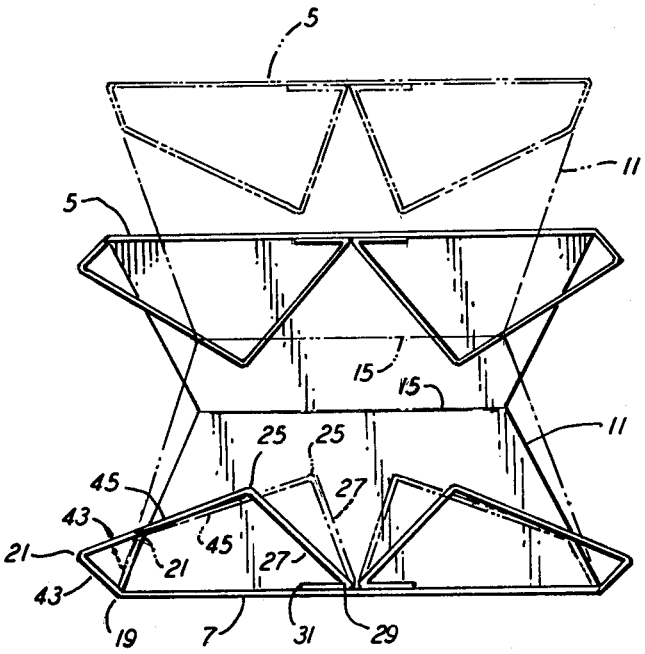
FIG. 3 is a cross sectional view of the carrier of FIG. 1 erected and in a partially collapsed condition.

The cooperation of the hinges formed along fold lines 19, 21, 25 and 29 is depicted in FIG. 3, a cross sectional view of carrier 1 along line 3—3 of FIG. 1. In FIG. 3, the solid lines show a sectional view of carrier 1 in a partially collapsed state while the broken lines show the same view of the carrier in the erect state. Web 47 pushes divider wall 27 to a position generally perpendicular to bottom wall 7 when the carrier is erected and pulls wall 27 toward bottom wall 7 when the carrier is collapsed. Divider wall 27 in turn causes the support panel to attain its erected position or to collapse toward bottom wall 7, respectively. An important relationship, illustrated in FIG. 3, must exist if the carrier is to be collapsible to a substantially flat condition. The lateral dimensions of the overlying parts of the collapsed collapsible retaining means must be the same if the carrier parts are not to be bent or deformed during collapse. That is, in the erect carrier, the lateral dimension of bottom wall 7 between fold lines 29 and 19 plus the minimum dimension of the narrow portion of support wall 17, i.e., the minimum dimension between fold lines 19 and 21, must substantially equal the sum of the transverse dimension of divider wall 27, i.e., the distance between fold lines 29 and 25, plus the minimum distance of the wide portion of support wall 17, i.e., the minimum dimension between fold lines 25 and 21. That is, the sums of the appropriate pairs of adjacent sides of the trapezoid formed, in cross section, by divider wall 27, support wall 17 and a portion of bottom wall 7 must be equal for the carrier to be collapsible.

In FIG. 3, the two divider walls secured to bottom wall 7 are shown abutting and symmetrically placed, i.e., adjoining the transverse center line of bottom wall 7. That placement minimizes the amount of carrier material needed; however, the divider walls need not abut each other, but could be spaced apart for greater separation of the ends of the articles to be inserted in carrier 1. As can be seen in FIG. 3, the opposing divider walls prevent articles in carrier 1 from directly contacting each other thereby reducing the probability of breakage of the articles in transit. The more widely spaced the divider walls, the greater the protection of the articles.

Although only one triangular web, web 47, is illustrated in FIG. 2, it is understood that in carrier 1 such a web connects each end of divider wall 27 to the proximate half side wall. Carrier 1 of FIG. 1 obviously includes eight such webs, with their fold and reverse fold boundaries acting as double acting hinges, coordinating the position of the support walls with the condition of the carrier. A carrier could, consistent with the invention, use the collapsible feature only on the bottom or top wall of a carrier or only on one-half of the top or bottom wall of a carrier or in other permutations within the skill of the art. An end of an article inserted into a carrier according to the invention, but not using collapsible retaining means to engage each end of the article, may be retained within the carrier by conventional means, such as by flaps engaging the exterior or interior periphery of the article, that do not interfere with collapsibility.

Figure 4:
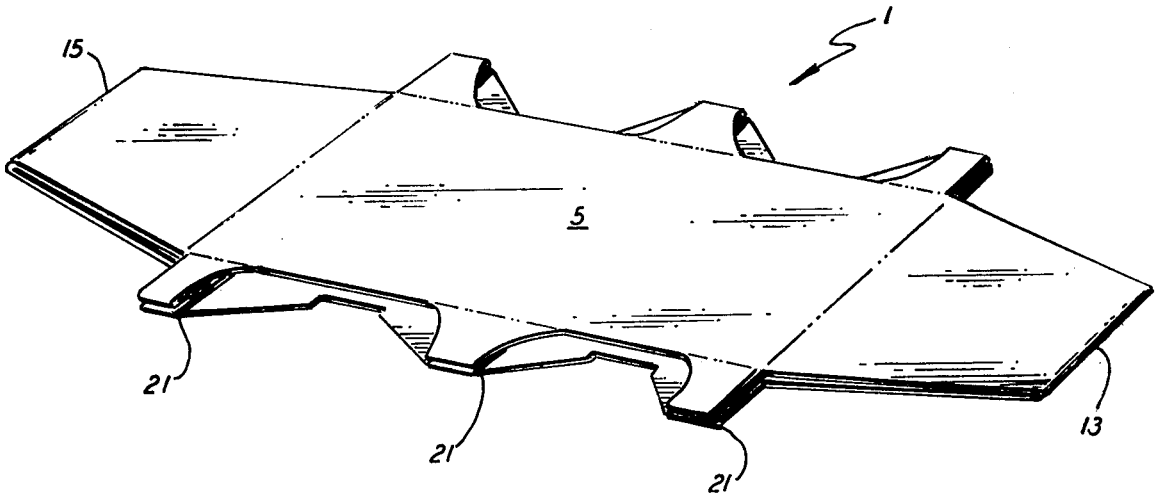
FIG. 4 is a perspective view of the carrier of FIG. 1 in a collapsed condition.

In FIG. 4, carrier 1 is shown fully collapsed to its substantially flat configuration. It may be noted from FIG. 4 that carrier 1 collapses symmetrically about the lateral plane intermediate of top and bottom walls 5 and 7 and containing fold lines 13 and 15. That is, in the collapsed carrier, nothing protrudes only along one side or the other of the carrier beyond the top and bottom walls. The known collapsible carriers having end walls, collapse along the hinges connecting the side walls and top and bottom walls requiring that the article retaining means be skewed to one side of the carrier or the other as a prerequisite for collapse. This skewing results in wasted space in packing the flattened carriers for shipment which is overcome in the present invention. Collapse of carrier 1 is simple as illustrated by FIGS. 3 and 4. A compressive force is simply applied to top and bottom walls 5 and 7 to collapse carrier 1. Carrier 1 is erected by applying the compressive force to fold lines 13 and 15.

Figure 5:
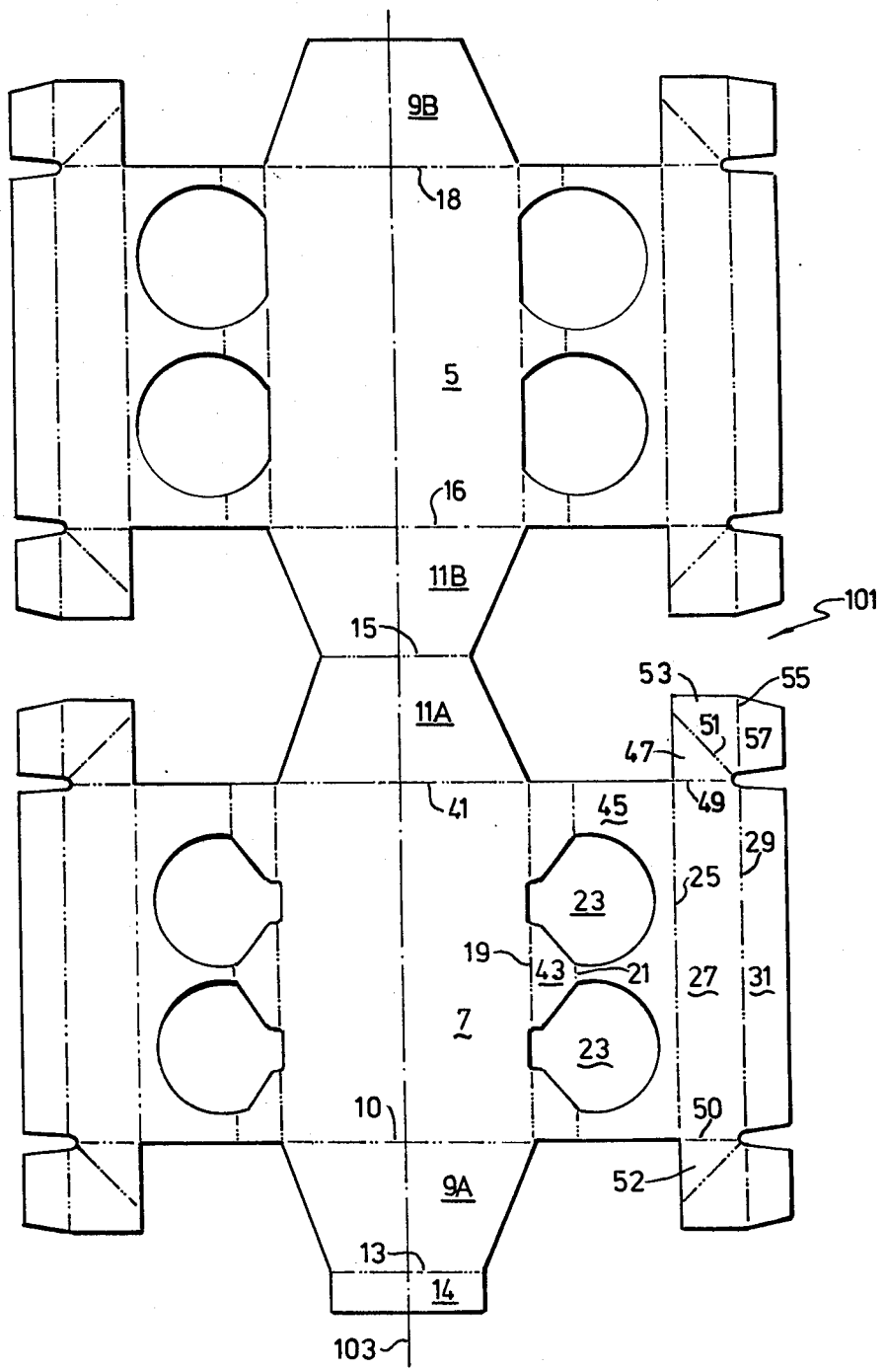
FIG. 5 is a plan view of a blank from which the carrier of FIG. 1 may be assembled.

Carrier 1 is preferably constructed from paperboard, cardboard or plastic sheet. In FIG. 5, a blank 101 is shown from which carrier 1 may be formed. Blank 101 is comprised of a transverse continuous array of panels joined by lateral fold lines and of panels laterally extending from said array along transverse fold lines. As pointed out earlier, for convenience of reference certain directions are taken as lateral while the perpendicular direction is termed transverse. Lateral fold line 15 of carrier 1 defines the lateral and transverse directions in FIG. 5. The face of blank 101 shown in FIG. 5 is the obverse face which forms the inside of carrier 1 and the opposite face of the blank is the reverse face. The elements in FIG. 5 are given the same reference numerals given those elements in FIGS. 1 through 4.

In blank 101, a first half side wall panel 9A is joined along a lateral fold line 10 to a bottom wall panel 7. A glue flap 14 extends transversely from half side wall panel 9A opposite bottom wall panel 7 along a lateral fold line 13. A second half side wall panel 11A extends transversely from bottom panel 7 along lateral fold line 41 and a third half side wall panel 11B extends from half side wall panel 11A along lateral fold line 15. A top wall panel 5 extends from third half side wall panel 11B along a lateral fold line 16. A fourth half side wall panel 9B extends from top wall panel 5 along lateral fold line 18.

Both top and bottom wall panels of blank 101 are further defined by transverse fold lines from which support wall panels laterally extend. Since blank 101 is symmetrical about a transverse medial line 103 and since the array of panels extending laterally from each of the top and bottom wall panels are identical in blank 101, except for the shapes of the openings in them, it is only necessary to describe one such lateral array of panels extending from bottom wall panel 7 to understand the blank and its assembly. Bottom wall panel 7, and the lateral array of panels extending from it, is symmetrical about a medial lateral line so that a description of a symmetrical half of the array is sufficient to describe all of it. Therefore, in the description that follows, reference to a fold line, panel flap, web or tab on one half of the lateral array refers to the designated element as well as its symmetrical counterparts on the other half of the lateral array and on the other lateral arrays of panels extending from the top and bottom wall panels.

A first support wall panel 45 extends laterally from bottom wall panel 7 along a transverse fold line 17 to a second transverse fold line 25. A first divider wall panel 27 laterally extends from fold line 25 to a transverse fold line 29. A securing flap 141 extends laterally from divider wall panel 27 along fold line 29. Divider wall panel 27 is also bounded by lateral fold lines 49 and 50. Extending transversely from fold lines 49 and 50 are triangular webs 47 and 52, respectively. Webs 47 and 52 are preferably identical so that only one need be described. Web 47 is bounded by an oblique reverse fold line 51 from which a securing tab 53 extends. A second securing tab 57 extends from tab 53 along a transverse fold line 55. Fold lines 23 and 55 are preferably colinear. Fold lines 29, 49, and 51 intersect at a point and a portion of the blank material at the intersection is removed to avoid binding in the assembly of a carrier from blank 101.

Support wall panel 45 contains a pair of partially elliptical openings 23 for engaging the ends of articles inserted into the carrier constructed from the blank. Each other support wall panel shown in FIG. 5 also includes openings. The shape of the openings varies to engage each end of the articles with which the carrier is to be used. Design of the shape of the openings to accept various article end shapes is known within the art. The number of openings depends upon the capacity of the carrier and one skilled in the art will understand that the number of openings depends upon the article capacity of the carrier and the type of retaining means employed. A transverse fold line 21 lies on support wall panel 45 intersecting openings 23. The lateral distance between center line 103 and fold line 21 is substantially equal to the lateral distance between fold line 21 and fold line 29.

As earlier explained, fold lines 29, 49, 51 and 55 are preferably combinations of cut or score and fold lines to aid assembly and to reduce the tendency of panels folded on those lines to resist the folds. With the exception of reverse fold line 51 and its equivalents, all fold lines in blank 101 are forward fold lines. That is, adjacent panels are folded along the fold lines by applying moments to the reverse side of the blank tending to bring two obverse faces into contact.

A carrier is constructed from blank 101 by first applying an adhesive to certain panels and then joining the panels together. Adhesive is deposited on the obverse faces of tabs 53 and 57, which are then brought into contact and adhered together. Securing flap 31 is then folded about fold line 29 and a transverse stripe of adhesive is deposited on the reverse face of securing flap 31 and on tab 57, and its equivalents. A transverse stripe of adhesive is also applied on bottom wall panel 7 adjacent center line 103, on the side toward support wall panel 45. These two stripes of adhesive on flap 31 and bottom wall panel 7 are brought into contact by folding the divider wall panel 27 and support wall panel 45 about fold lines 19, 25 and 21, as necessary. Preferably, in the resulting bond, fold line 29 is aligned with and lies adjacent to center line 103 on the side toward fold line 19. After divider wall panel 27 is attached to bottom wall panel 7 in the manner just described, half side wall panel 11A is bent along fold line 41 to a position approximately perpendicular to bottom wall panel 7 and the reverse side of tab 57, which has already received a stripe of adhesive, is adhered to the obverse side of half side wall panel 11A. To make the attachment, joined tabs 53 and 57 must be bent along reverse fold line 51; that is, the desired folding along fold line 51 is accomplished by applying moment forces to the obverse side of web 47 and tab 53 (i.e., the reverse side of tab 57 which has been glued to tab 53). In making the attachment, tabs 53 and 57 are positioned on half side wall panel 11A so that the intersection of fold lines 29, 49, and 51 lies on fold line 41. This configuration allows the assembled carrier to be collapsed in the manner previously described.

The entire carrier is assembled by next attaching the tabs at the opposite end of divider wall panel 27 to half wall panel 9A in the manner just described. Then the process is repeated for the panels laterally extending from the opposing side of bottom wall panel 7. The entire process is repeated for top wall panel 5. Then the carrier sleeve is closed by applying adhesive to the reverse side of glue tab 14 and laterally along the obverse side of half side wall panel 9B. These two elements are joined by folding the carrier panels around fold lines 10, 41, 16 and 18, as necessary, to adhere tab 14 and panel 9B together.

The assembled carrier may be collapsed, as previously described, by pressing on the outside, i.e., the reverse side of the blank of FIG. 5, of top and bottom wall panels 7 and 5. The carrier collapses by the hinge action of fold lines 15 and 13 with divider wall panel 27 and support wall panel 45 being brought generally parallel to bottom wall panel 7 by the forces transmitted from the half side wall panels by web 47 and its equivalent. The other divider wall panels and support wall panels are similarly flattened by the equivalent carrier elements.

In assembly of blank 101, the divider wall panel hinges are described as adjoining center line 103 on bottom wall panel 7. As noted in connection with FIG. 3, the divider walls attached to a top or bottom wall may abut or be spaced from each other. Likewise, each top and bottom wall panel need not have a collapsible retaining means such as the embodiments shown in FIG. 5. Other retaining means for ends of the articles to be inserted into the carrier which do not interfere with collapsing may be used in place of some of the collapsible retaining means, within the scope of the invention.

The invention has been described with reference to a certain preferred embodiment. Various changes, substitutions and additions will occur to those skilled in the art without departing from the spirit of the invention. Accordingly, the scope of the invention is limited solely by the following claims.

I claim:

1. A collapsible display carrier for articles inserted into the carrier, said carrier comprising;

opposing top and bottom walls having transverse and lateral edges;

opposing side walls laterally hingedly attached to said lateral edges of said top and bottom walls to form a sleeve said side walls including lateral fold lines defining upper and lower half side walls and acting as lateral hinge axes for collapsing said carrier to a substantially flat configuration about a lateral plane lying intermediate of said top and bottom walls; and collapsible retaining means for engaging articles inserted into said carrier, said collapsible retaining means comprising a divider wall hingedly secured to said bottom wall along a first transverse hinge axis and extending between said opposed lower half side walls, a support wall hingedly attached to said divider wall and extending from said support wall to said bottom wall and hingedly attached to a first transverse edge of said bottom wall, said support wall including a second transverse hinge axis, and hinge means depending from said divider wall and fastened to one of said lower half side walls for collapsing said retaining means to a substantially flat configuration when said carrier is collapsed to a substantially flat configuration.

2. The invention of claim 1 wherein said lateral fold lines lie medially on said side walls.

3. The invention of claim 1 wherein said support wall includes at least one partially elliptical opening for engaging an end of article inserted into said carrier and wherein said second transverse hinge axis intersects said opening.

4. The invention of claim 1 wherein said hinge means comprises a hinge including two hinge axes, the first of said axes lying substantially on one of said lower half side walls proximate said divider wall, the second of said axes lying at said divider wall adjacent said one of said lower half side walls, said axes and said first transverse hinge axis intersecting in a point lying on said lateral hinged attachment of said bottom wall to said one of said lower half side walls.

5. The invention of claim 4 wherein said hinge including two axes includes a web spanning said first and second axes, and a securing tab extending from said web, said first axis comprising a fold line lying between said web and said divider wall, said second axis comprising a reverse fold line lying between said web and said securing tab, said securing tab being secured to said one of said lower half side walls.

6. The invention of claim 4 wherein the lateral dimension between said divider wall and said hinged attachment of said support wall to said bottom wall, plus the minimum dimension between (i) said hinged attachment of said bottom wall and support wall and (ii) said second transverse hinge axis, is substantially equal to the minimum dimension between (iii) said hinged attachment of said divider wall and said support wall and (iv) said first transverse hinge axis, plus the minimum dimension between (v) said hinged attachment of said divider wall and said support wall and (vi) said second transverse hinge axis.

7. The invention of claim 1 further including second collapsible retaining means comprising a second divider wall hingedly secured to said bottom wall along a third transverse hinge axis and extending between said opposed lower half side walls, a second support wall hingedly attached to said second divider wall and extending from said second support wall to said bottom wall and hingedly attached to a said second transverse edge of said bottom wall opposing said first transverse edge, said second support wall including a fourth transverse hinge axis, and second hinge means depending from said second divider wall and fastened to one of said lower half side walls for collapsing said second retaining means to a substantially flat configuration when said carrier is collapsed to a substantially flat configuration.

8. The invention of claim 7 wherein said second hinge means comprises a hinge including third and fourth hinge axes, the third said axis lying substantially on one of said lower half side walls proximate said second divider wall, the fourth said axis lying at said second divider wall adjacent said one of said lower half side walls, said axes and said third transverse hinge axis intersecting in a point lying on said lateral hinged attachment of said bottom wall to said one of said lower half side walls.

9. The invention of claim 8 wherein said hinge including third and fourth axes includes a second web spanning said third and fourth axes, and a second securing tab extending from said web, said third axis comprising a fold line lying between said second web and said second divider wall, said fourth axis comprising a reverse fold line lying between said web and said second securing tab, said second securing tab being secured to said one of said lower half side walls.

10. The invention of claim 8 wherein the lateral dimension between said second divider wall and said hinged attachment of said second support wall to said bottom wall, plus the minimum dimension between (i) said hinged attachment of said bottom wall and said second support wall and (ii) said fourth transverse hinge axis, is substantially equal to the minimum dimension between (iii) said hinged attachment of said second divider wall and said second support wall and (iv) said third transverse hinge axis, plus the minimum dimension between (v) said hinged attachment of said second divider wall and said second support wall and (vi) said fourth transverse hinge axis.

11. A blank for forming a collapsible display carrier for articles inserted into said carrier, said blank comprising:

a transverse, continuous array of panels joined along lateral fold lines including a first half side wall panel joined along a first lateral fold line to a bottom wall panel, said bottom wall panel being joined along a second lateral fold line to a second half side wall panel, said second half side wall panel being joined along a third lateral fold line to a third half side wall panel, said third half side wall panel being joined along a fourth lateral fold line to a top wall panel, said top wall panel being joined along a fifth lateral fold line to a fourth half side wall panel; and a first support wall laterally extending from said bottom wall panel along a first transverse fold line defining a first transverse edge of said bottom wall panel, a first divider wall panel laterally extending from said first support wall panel along a second transverse fold line, a first web transversely extending from said first divider wall panel along a fifth lateral fold line, a first securing tab extending from said first web along a first oblique reverse fold line, and a first securing flap extending laterally from said first divider wall along a third transverse fold line; said reverse fold line and said fifth lateral fold line intersecting each other, said third transverse fold line, and one of said second and fifth lateral fold lines in a point.

12. The blank of claim 11 wherein said bottom wall includes a transverse center line, said first support wall includes a fourth transverse fold line and the lateral distance between said third and fourth transverse fold lines is substantially equal to the lateral distance between said fourth transverse fold line and the transverse center line of said bottom wall panel.

13. The blank of claim 11 further including a second support wall laterally extending from said bottom wall panel, opposite said first support wall, along a fifth transverse fold line defining a second transverse edge of said bottom wall, a second divider wall panel laterally extending from said second support wall panel along a sixth transverse fold line, a second web transversely extending from said second divider wall panel along a sixth lateral fold line, a second securing tab extending from said second web along a second oblique reverse fold line, and a second securing flap extending laterally from said second divider wall panel along a seventh transverse fold line, said second reverse fold line and said sixth lateral fold line intersecting each other, said seventh transverse fold line, and one of said second and fifth lateral fold lines, in a point.

14. The blank of claim 13 wherein said second support wall includes an eighth transverse fold line and the lateral distance between said seventh and eighth transverse fold lines is substantially equal to the lateral distance between said eighth transverse fold line and the transverse center line of said bottom wall panel.

* * * * *